US008702475B2

(12) United States Patent
Stroppel et al.

(10) Patent No.: US 8,702,475 B2
(45) Date of Patent: Apr. 22, 2014

(54) GRINDING MACHINE FOR GRINDING WORKPIECES

(75) Inventors: Berthold Stroppel, Sigmaringen (DE); Daniel Mavro, Stephanskirchen (DE)

(73) Assignee: Schaudt Mikrosa GmbH, Leipzig (DE)

( * ) Notice: Subject to any disclaimer, the term of this patent is extended or adjusted under 35 U.S.C. 154(b) by 640 days.

(21) Appl. No.: 12/887,296

(22) Filed: Sep. 21, 2010

(65) Prior Publication Data

US 2011/0151750 A1 Jun. 23, 2011

(30) Foreign Application Priority Data

Sep. 22, 2009 (DE) ..... 10 2009 047 913

(51) Int. Cl.
*B24B 5/02* (2006.01)
*B24B 5/313* (2006.01)

(52) U.S. Cl.
USPC ..... 451/65; 451/62; 451/246

(58) Field of Classification Search
USPC ..... 451/49, 58, 62, 65, 66, 178, 179, 246, 451/242, 360, 361, 363, 398
See application file for complete search history.

(56) References Cited

U.S. PATENT DOCUMENTS

| | | | | |
|---|---|---|---|---|
| 4,907,374 | A * | 3/1990 | Brill | 451/342 |
| 5,185,959 | A * | 2/1993 | Ikola et al. | 451/178 |
| 5,259,150 | A * | 11/1993 | Himmelsbach | 451/62 |
| 5,355,633 | A * | 10/1994 | Ishikawa et al. | 451/5 |
| 5,410,843 | A * | 5/1995 | Gottschald | 451/43 |
| 5,643,052 | A * | 7/1997 | Delattre et al. | 451/21 |
| 5,951,381 | A * | 9/1999 | Videcoq et al. | 451/255 |
| 6,390,907 | B1 * | 5/2002 | Metzler et al. | 451/360 |
| 6,419,563 | B1 * | 7/2002 | Ido et al. | 451/57 |
| 7,037,173 | B2 * | 5/2006 | Nonoyama et al. | 451/5 |
| 2012/0164926 | A1 * | 6/2012 | Himmelsbach | 451/397 |

FOREIGN PATENT DOCUMENTS

| | | |
|---|---|---|
| DE | 1 789 908 | 3/1959 |
| DE | 103 04 252 | 8/2004 |
| EP | 0 269 100 | 11/1987 |

OTHER PUBLICATIONS

"CamGrind-Produktionsloesungen fuer das Schleifen von Nockenwellen" Studer Schaudt GmbH, Stuttgart (Oct. 2006).
"The Range—Your Application Defines the Solution" Studer Schaudt GmbH, Stuttgart (Dec. 2008).

* cited by examiner

*Primary Examiner* — Timothy V Eley
(74) *Attorney, Agent, or Firm* — Greenblum & Bernstein P.L.C.

(57) ABSTRACT

Grinding machine for grinding workpieces, in particular cams, a grinding machine holder and a method for grinding cam sets using such a grinding machine. Grinding machine comprising a machine bed, at least one grinding spindle, two grinding wheel holders, on which in each case at least one grinding wheel is arranged and which are arranged in opposite directions to one another in their orientation and are oriented parallel to one another with their longitudinal axes, and two workholding devices which in each case have a work headstock and a steady rest and which are arranged in opposite directions to one another in their orientation and are oriented parallel to one another with their longitudinal axes, wherein each work headstock and the associated steady rest are designed for the arrangement therebetween of a separate work fixture having workpieces to be ground.

11 Claims, 7 Drawing Sheets

GRINDING MACHINE FOR GRINDING WORKPIECES

CROSS-REFERENCE TO RELATED APPLICATIONS

This application claims priority under 35 U.S.C. §119(a) to German application no. 10 2009 047 913.9, filed on 22 Sep. 2009, the disclosure of which is expressly incorporated by reference herein in its entirety.

BACKGROUND OF THE INVENTION

1. Field of the Invention

The present invention relates to a grinding machine for grinding workpieces, in particular cams, and to a grinding wheel holder and a method for grinding cam sets.

2. Discussion of Background Information

Grinding machines of this type are known, for example, from the brochure "CamGrind—Produktionsloesungen fuer das Schleifen von Nockenwellen" [CamGrind—production solutions for the grinding of camshafts] from Studer Schaudt GmbH, Stuttgart, dated October 2006. In this publication, for example, the model "CamGrind S" has a grinding device which consists of a large grinding wheel and of a small grinding wheel and is conceived in particular for grinding camshafts. With the large grinding wheel, first of all the cams are pre-ground and the bearing seats machined with high productive capacity, whereas the small grinding wheel serves to finish grind the cam shapes or also to grind the bearing seats. For the machining of the camshaft, said camshaft is arranged on a workholding device which has a work headstock on one side, said work headstock setting the camshaft in the desired rotation about its longitudinal axis, and a tailstock on the other side, said tailstock ensuring that the camshaft is always oriented and centered during the machining. Compared with these, as a rule stationary, components of the workholding device, the grinding wheels or the corresponding grinding spindles are movable relative to the camshaft within the x-z plane.

Where axes or directions x and z are referred to above or below, this always means the two axes which define the plane which forms the machine bed. In this case, the z-axis extends parallel to the longitudinal extent of the workpiece, here, for example, the camshaft, and the x-axis extends as an axis perpendicular thereto, which therefore corresponds to a movement of a tool towards or away from the corresponding workpiece from the side. Furthermore, a direction perpendicular to the x- and z-axes is designated as y-axis or y-direction. It consequently runs perpendicularly to the machine bed.

The grinding of the cams directly on the shaft is carried out for the sake of accuracy so that the cams are formed exactly with respect to the shaft. Compared with this established method, the grinding of individual cams is being increasingly used, since manufacturers of camshafts have in the meantime been successful in being able to join the individual cams to a shaft in a very exact manner. In this case, the exact grinding of the individual cams takes place individually or as groups of a plurality of cams which are usually machined on a work fixture, as a rule a mounting arbor in a grinding machine.

SUMMARY OF THE INVENTION

Since the previous grinding machines have been designed and optimized for the machining of already prefabricated complete camshafts, the object of the invention is to provide an optimized grinding machine adapted to the workpiece of the individual cams, a grinding wheel holder and a method for grinding cam sets.

According to the invention, this object is achieved by a grinding machine for grinding workpieces, in particular cams, comprising a machine bed, at least one grinding spindle, two grinding wheel holders, on which in each case at least one grinding wheel is arranged and which are arranged in opposite directions to one another in their orientation and are oriented parallel to one another with their longitudinal axes, and two workholding devices which in each case have a work headstock and a steady rest and which are arranged in opposite directions to one another in their orientation and are oriented parallel to one another with their longitudinal axes, wherein each work headstock and the associated steady rest are designed for the arrangement therebetween of a separate work fixture having workpieces to be ground, and the steady rests are preferably arranged along the z-axis between the work headstocks.

In this case, the designation "at least one grinding spindle" comprises, in accordance with the context, both a single grinding spindle on which two grinding spindle holders with grinding wheels can be arranged and two separate grinding spindles which serve to accommodate these grinding wheel holders.

The design of the workholding device in such a way that an individual work fixture together with the workpieces to be ground, here in particular cams, can be arranged between a work headstock and a steady rest has the advantage that the steady rest used requires less space than the tailstock used in the known grinding machines for complete camshafts. The possibility of using a steady rest—a device which is also known as a back stay—instead of a tailstock in the present invention arises from the fact that the length of the work fixtures used is markedly smaller than a complete camshaft.

The result of the smaller space required by the steady rest is that the grinding spindle running in parallel along the z-axis next to this steady rest can be moved up closer to this steady rest along the x-axis. Furthermore, this results in greater flexibility in the use of the grinding wheels which are arranged on the grinding spindle. The latter now no longer need to have a certain minimum size which is due to the fact that the grinding spindle cannot exactly be brought very close up to the camshaft, since the tailstock was decisive here for the smallest distance between grinding spindle and camshaft.

Here, the work fixture is preferably formed by a mounting arbor. The workpieces to be machined are arranged one after the other on this mounting arbor.

A further advantage of the present invention is the two separate workholding devices, which can each accommodate a work fixture. It is therefore possible for two work fixtures with workpieces to be machined to be arranged in the grinding machine at the same time. Thus, while the workpieces are ground on a first work fixture, the workpieces already machined beforehand can be removed together with their work fixture from the workholding device and can be replaced by a work fixture having unmachined workpieces. If the grinding operation on the workpieces in the first workholding device is complete, the grinding machine can immediately continue the grinding operation on the workpieces that have now just been clamped in the second workholding device. As a result, non-productive times, during which the grinding machine is not carrying out grinding operations, are reduced to a minimum.

A further advantage in this connection is found in the orientation of the grinding wheel holders and the workholding devices relative to one another.

Due to the arrangement of the workholding devices in opposite directions to one another, with simultaneous parallel orientation of their longitudinal axes, it is possible for the work fixture with the workpieces to be machined to be arranged in parallel, preferably in a plane perpendicular to the x-z plane. By the further orientation of the steady rests between the work headstocks, the work fixtures in the workholding device together with the workpieces point substantially inwards, whereas the work headstocks with the drives point outwards as viewed from that location. This means that the grinding wheels, which are moved back and forth, for example, between the work fixtures between the grinding operations, likewise only have to cover the shortest possible distances. As a result, the abovementioned non-productive times are decisively reduced yet again.

Furthermore, this advantage is sustained by the grinding wheels being arranged on two grinding wheel holders, which are in turn likewise arranged in opposite directions to one another and are oriented parallel to one another. This enables these two grinding wheel holders to be arranged, for example, on the two sides, pointing outwards along the z-axis, of a drive unit of the grinding wheel holders, which is preferably formed here by the at least one grinding spindle. As a result of the arrangements described above, this at least one grinding spindle is arranged between the workholding devices and is moved back and forth, together with the grinding wheel holders likewise arranged between the latter, along the z-axis between the workholding devices in order to be able to carry out the appropriate grinding operations.

In a further configuration of the invention, the grinding machine has a single grinding spindle, wherein one of each of the two grinding wheel holders is arranged on each side of the grinding spindle. This configuration has the advantage that only one grinding spindle has to be used for the two grinding wheel holders having the grinding wheels. As a result, the space required by the drives for the grinding wheel holders is reduced in height and depth. Furthermore, the material costs in the construction of such a grinding machine are also kept low.

In another configuration of the invention, the grinding machine has two separate grinding spindles, wherein one of each of the two grinding wheel holders is arranged on each of the two separate grinding spindles. The use of two separate grinding spindles has the advantage that the automatic balancing in the case of such grinding spindles can be realized in a much simpler manner and with less complications compared with grinding spindles having a tool connection on both sides. This has a positive effect on the minimizing of the material wear and on the accuracy of the machined workpieces.

In a further configuration of the invention, the two separate grinding spindles are jointly arranged on a slide which is arranged on the machine bed in a traversable manner. The arrangement of the grinding spindles on a common traversable slide has the advantage that the release of the workpieces just machined and the orientation of the other grinding spindle to the workpieces to be machined is realized by merely one unit to be controlled. The control is therefore combined and simplified and at the same time the number of possible error sources is reduced.

In a further configuration of the invention, the two workholding devices are each arranged at different distances above the machine bed and the two grinding wheel holders are each arranged at different distances above the machine bed. The advantage of this configuration of the invention is that this makes it possible to split the machining of the different workpieces in the two workholding devices into two separate planes. These planes run parallel to the x-z plane. Compared with an arrangement within a common plane, this has the advantage that the space required by the complete grinding machine within the x-z plane is minimized.

In an alternative configuration of the invention, the two workholding devices are each arranged at the same distance above the machine bed and the two grinding wheel holders are each arranged at the same distance above the machine bed. This configuration of the invention has the advantage that the space required by the complete resulting grinding machine is minimized in the height direction above the machine bed, that is to say perpendicularly to the x-z plane. This is because it is possible in this way to arrange the two workholding devices with the workpieces to be machined within one and the same plane which runs parallel to the x-z plane.

In a further configuration of the invention, the spindle axis of a respective work headstock is arranged in a plane with the spindle axis of a respective grinding spindle, said plane being substantially parallel to the plane defined by the x- and z-axes. This configuration ensures that the grinding wheels, which are driven by the corresponding grinding spindle, can be brought up to the workpieces, rotating about the spindle axis of the work headstock, as far as possible in an optimum manner for the machining. This is achieved by a movement within a plane parallel to the x-z plane. Consequently, the pressure which is generated by the grinding wheels being pressed against the workpieces to be ground is transmitted to the central axis of the axis of rotation of the workpieces to be machined. The line of action of the grinding wheels therefore runs through the axis of rotation of the workpieces, which has a positive effect on the accuracy of the grinding operation.

The expression "substantially parallel" is also intended to include in this case differences between the two planes of up to 10°, but is preferably intended to mean exactly parallel.

In a further configuration of the invention, at least three, in particular four or five grinding wheels are arranged on a grinding wheel holder. Due to this arrangement of grinding wheels on a grinding wheel holder, it is consequently possible to simultaneously grind three, in particular four or five workpieces. In this case, preferably one grinding wheel serves to grind one workpiece.

In a further configuration of the invention, the radial distance from the spindle axis of the at least one grinding spindle up to an outer edge of the spindle block of the grinding spindle is greater than or equal to the radius of the grinding wheels. The advantage of this measure is that the grinding wheels used are therefore relatively small. Small grinding wheels have the advantage that they permit more accurate grinding of the workpieces. They therefore enable, for example, cams to be provided with concave radii in the flanks.

Despite such a grinding wheel of small size, it is possible for the grinding spindle to still retain relatively large dimensions in accordance with this configuration of the present invention. This consequently permits a high performance of the grinding spindle. Therefore, despite a smaller size of the grinding wheel used, an appropriate machining speed for the workpieces to be machined can be maintained or achieved.

In a further configuration of the invention, the grinding wheels each have a roof profile. This measure has the advantage that the formation of burrs on the front and rear edges of the workpieces, as viewed along the z-axis, that is to say in the longitudinal direction of the work fixture, is prevented or that burrs are simpler to remove.

The expression "roof profile" refers in this case to a recess which can be recognized in the grinding material in the cross section of a grinding wheel which intersects the grinding wheel in a plane which contains both its axis of rotation and a radius. This recess runs in such a way that, as viewed from one edge of the grinding wheel parallel to the axis of rotation in the direction of the other edge of the grinding wheel, there is in each case a larger radius of the grinding wheel at the front and the rear than in a region lying in between, these regions being connected to one another by a steep transition, such that the resulting cross-sectional profile resembles the shape of a roof.

The present invention likewise discloses, along with the grinding machine, a grinding wheel holder.

Hitherto known grinding wheel holders or grinding wheels for the simultaneous machining of a plurality of workpieces consist of "segmented grinding wheels" which consist of helically arranged, rhombic grinding material plates adhesively bonded in place. Such grinding wheels are relatively complicated to produce and are consequently expensive, which has an adverse effect on the final price of the workpieces to be machined.

It is therefore also the object of the present invention to provide a grinding wheel holder which permits more cost-effective grinding of a plurality of workpieces at the same time.

According to the invention, this object is achieved by a grinding wheel holder comprising a bar-shaped support element, a fastening device for fastening the grinding wheel holder to a grinding spindle, and at least three, in particular four or five grinding wheels, wherein the fastening device is arranged at one end of the bar-shaped support element, the grinding wheels are arranged at a distance from one another on the grinding wheel holder, and a grinding wheel serves to grind one of at least three, in particular four or five workpieces arranged on a holder.

The advantage of this aspect of the invention is that already existing grinding wheels can be used for the grinding wheel element, thus obtained, in the form of this grinding wheel holder having the individual grinding wheels, and therefore no special production of a continuous broad grinding wheel is necessary. The production costs are therefore drastically reduced, which has a positive effect on the final costs of the workpieces to be machined.

In a further configuration of the invention, the gap between two adjacent grinding wheels is smaller than the distance between two adjacent workpieces to be machined, and the grinding wheels preferably have a roof profile. This measure has the advantage that, due to the larger distances between the workpieces to be machined, compared with the grinding wheels, the grinding wheels can accordingly project beyond the edge of the workpieces. The grinding wheels can therefore also be used for machining burr that has been produced.

This is especially advantageous when the grinding wheels have a roof profile. As a result, as already explained above in detail, the burr produced on a workpiece by the grinding operation can be simultaneously removed by this shape.

In a further configuration of the grinding machine, the grinding wheel holders are designed in accordance with the above statements. This combination of grinding wheel holders on the grinding machine described above allows effective and precise grinding of the workpieces to be ground.

A further subject matter of the present invention is a method for grinding cam sets which in each case have at least three, in particular four or five cams which are arranged on a work fixture and are machined with a grinding machine in accordance with the above statements.

According to the invention, this method contains the following steps:

a) automatic clamping of a first cam set between the first work headstock and the associated steady rest of the first workholding device, with subsequent rotation of the first cam set about the spindle axis of the first work headstock, b) orientation of the at least one grinding spindle, such that each grinding wheel of the first grinding wheel holder is level with a respective cam of the first cam set along the z-axis, with subsequent grinding of the cams of the first cam set, c) automatic depositing, in particular at the same time as step b), of a possibly already present, ground second cam set from the second workholding device and automatic clamping of a third cam set between the second work headstock and the associated steady rest of the second workholding device, with subsequent rotation of the third cam set about the spindle axis of the second work headstock, d) orientation of the at least one grinding spindle, such that each grinding wheel of the second grinding wheel holder is level with a respective cam of the third cam set along the z-axis, with subsequent grinding of the cams of the third cam set, and e) automatic depositing, in particular at the same time as step d), of the first cam set from the first workholding device, and repetition of steps a) to e).

This method enables the non-productive times between the effective grinding operations to be reduced to a minimum, said non-productive times only still consisting of the orientation of the grinding spindle from the first to the second (or vice versa) workholding device. A non-productive time for exchanging an already ground cam set for a cam set to be ground, which can take several seconds, is therefore dispensed with. The result is an increased production rate and consequently lower production costs.

It goes without saying that the abovementioned features and the features still to be explained below can be used not only in the specified combination but rather also in other combinations or on their own without departing from the scope of the present invention.

BRIEF DESCRIPTION OF THE DRAWINGS

The invention is described and explained in more detail below with reference to selected exemplary embodiments in connection with the attached drawings, in which.

DETAILED DESCRIPTION OF THE EMBODIMENTS

Figure 1:
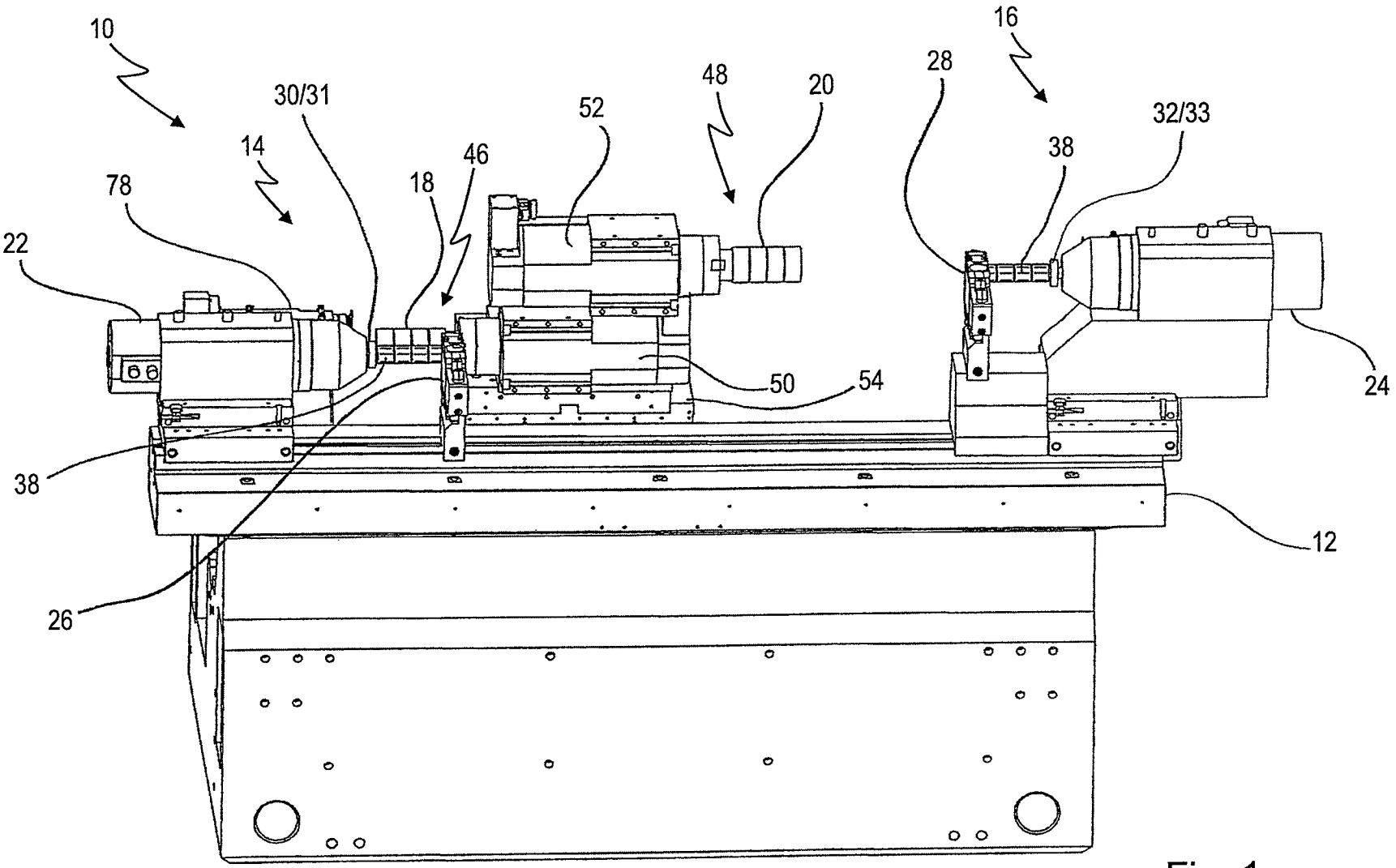
FIG. 1 shows a perspective side view of a grinding machine according to the present invention.

A grinding machine according to the invention shown in FIGS. 1 to 4 is designated overall by reference numeral 10.

The grinding machine 10 shown in FIGS. 1 to 4 has, as basic components, a machine bed 12, workholding devices 14 and 16, and grinding wheels 18 and 20. The machine bed 12 forms the base plane for the components belonging to the grinding machine 10, such as, for example, the workholding devices 14, 16 and the drives and arrangements for the grinding wheels 18, 20. These components are partly movably arranged on said machine bed 12. Since the table plane of the machine bed 12 runs parallel to a plane defined by the x-axis and the z-axis, these movements are as a rule effected along this x-axis and this z-axis. The directions of the x- and z-axes can best be seen from FIG. 3.

The workholding devices 14 and 16 each consist of a work headstock 22, 24 and an associated steady rest 26, 28. A work fixture 30 or 32 which is formed here by a mounting arbor 31 or 33, respectively, is arranged between work headstock 22 and steady rest 26 and respectively between work headstock 24 and steady rest 28. This can be readily seen in particular in the detailed view of FIGS. 4 and 5.

Figure 4:
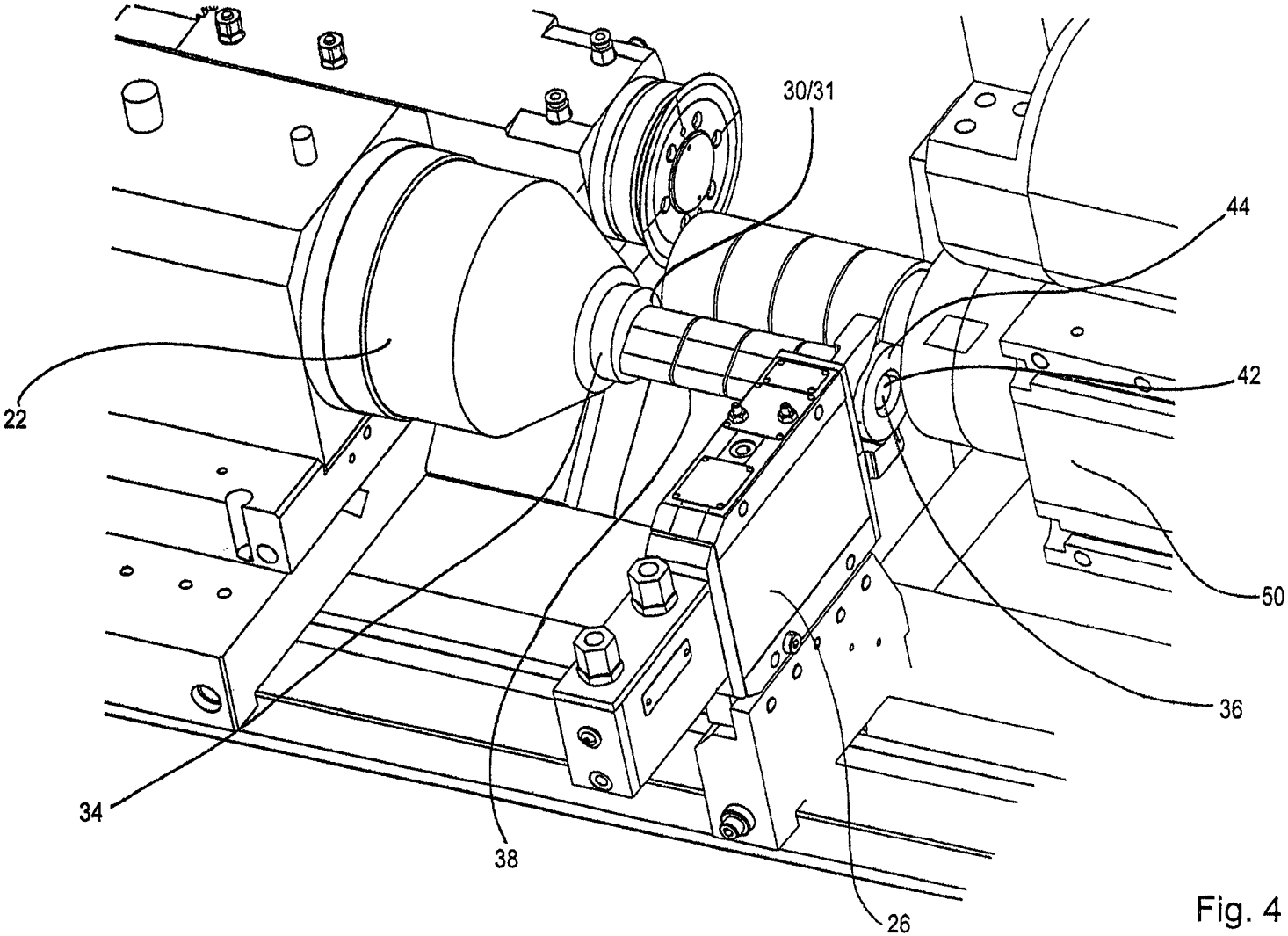
FIG. 4 shows a cutaway perspective view of the grinding machine from FIGS. 1 to 3 in the region of a workholding device and the grinding wheels oriented relative thereto.
Figure 5:
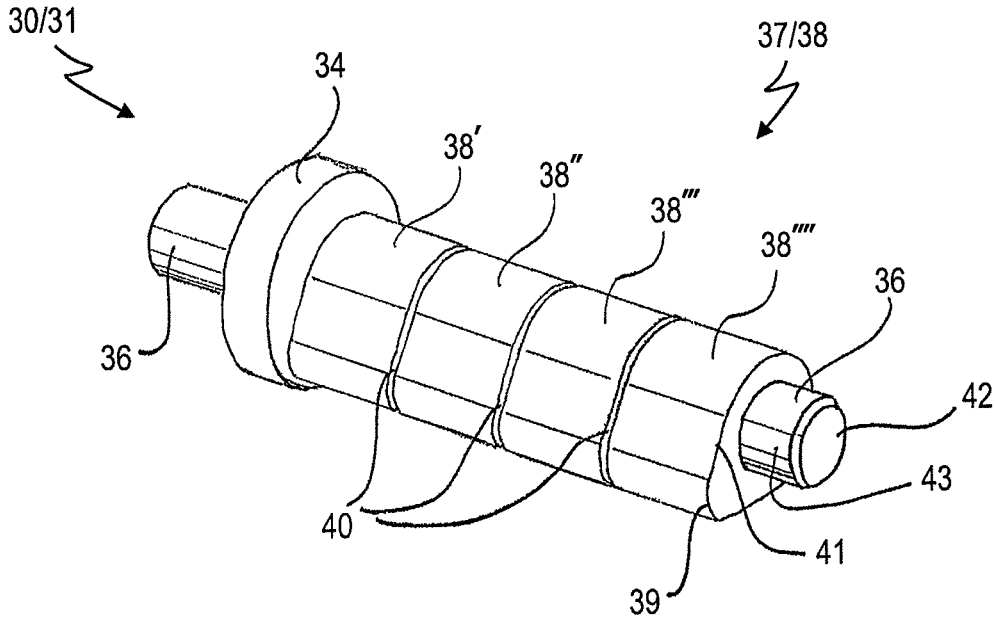
FIG. 5 shows a perspective detailed view of a work fixture for the grinding machine according to the invention in FIGS. 1 to 4.

The construction and the composition of the work fixture 30 or 32 is to be described in more detail below with reference to FIGS. 4 and 5, reference only being made in this respect to one of the two workholding devices 14 and 16 present, although the features explained apply in the same manner to the other workholding device 16 present and the work fixture 32 arranged thereon.

The work fixture 30 or the mounting arbor 31 consists of a connection piece 34 and a bar-shaped support 36. Workpieces 37, here cams 38, are arranged one after the other on this bar-shaped support 36. To this end, within the scope of the invention, at least three, but in particular four or five cams 38 are arranged on the bar-shaped support 36. In this case, the exemplary embodiment shown in FIGS. 4 and 5 shows an embodiment with four cams 38' to 38"". The cams 38 are oriented to one another in such a way that there is a slight gap 40 between them in the direction of the longitudinal extent of the bar-shaped support 36. Furthermore, they are oriented relative to one another in such a way that their cam heads 39 and flanks 41 (shown by way of example on cam 38"" in FIG. 5) are in alignment with respect to the longitudinal extent of the bar-shaped support 36.

At the opposite end 42 of the bar-shaped support 36 remote from the connection piece 34, a short exposed portion 43 of the bar-shaped support 36 remains behind the last cam 38"", with which remaining portion 43 the support 36 is arranged, on the opposite side remote from the work headstock 22, in a support receptacle 44 of the steady rest 26.

The construction and the arrangement of the grinding wheels 18 and 20 is now to be explained in more detail below, first of all in connection with FIGS. 1 to 4 and FIG. 6.

The grinding wheels 18, 20 are in each case arranged one after the other on grinding wheel holders 46, 48. The latter in turn, in the present exemplary embodiment, are arranged on respective grinding spindles 50 and 52, and an arrangement of the two grinding wheel holders 18 and 20 on an individual grinding spindle (not shown in any more detail) having opposite connection means also forms an embodiment according to the invention. The grinding spindle 50, 52 constitutes the respective drive for the grinding wheel holders 46, 48 and, in conjunction therewith, also for the grinding wheels 18, 20.

In order to correspondingly reach the workpieces to be ground, here the cams 38, the grinding spindles 50, 52 are arranged on a common slide 54. This slide 54 is itself arranged on the machine bed 12 and is traversable on the latter in both the x-axis and the z-axis, as will be explained in more detail below.

In the exemplary embodiment of the grinding machine 10 shown, the grinding spindles 50 and 52 are arranged one below the other with respect to the machine bed 12 or the x-z plane, as can best be seen from FIGS. 1 and 2. Nonetheless, the arrangement (not shown in any more detail here) of the grinding spindles in a plane which runs parallel to the x-z plane, i.e. one behind the other or side by side, also constitutes an embodiment according to the invention.

Figure 6:
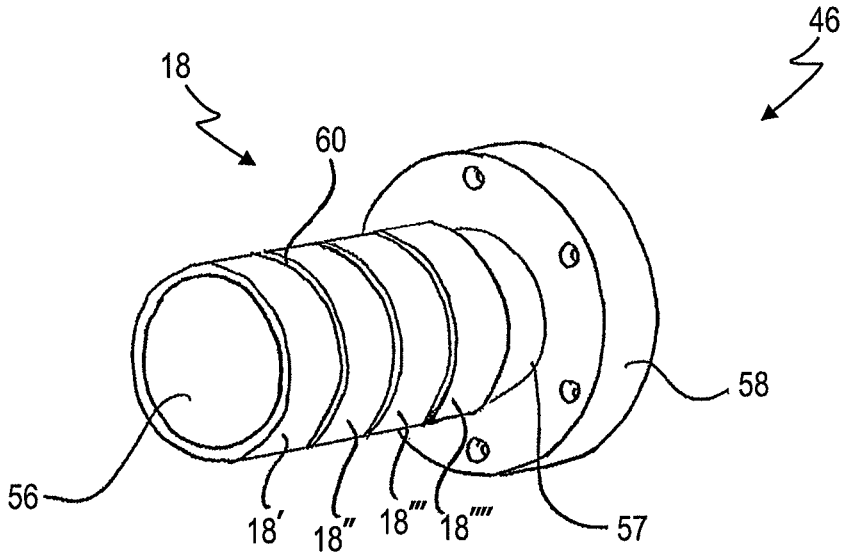
FIG. 6 shows a grinding wheel holder according to the invention in a perspective illustration.
Figure 7:
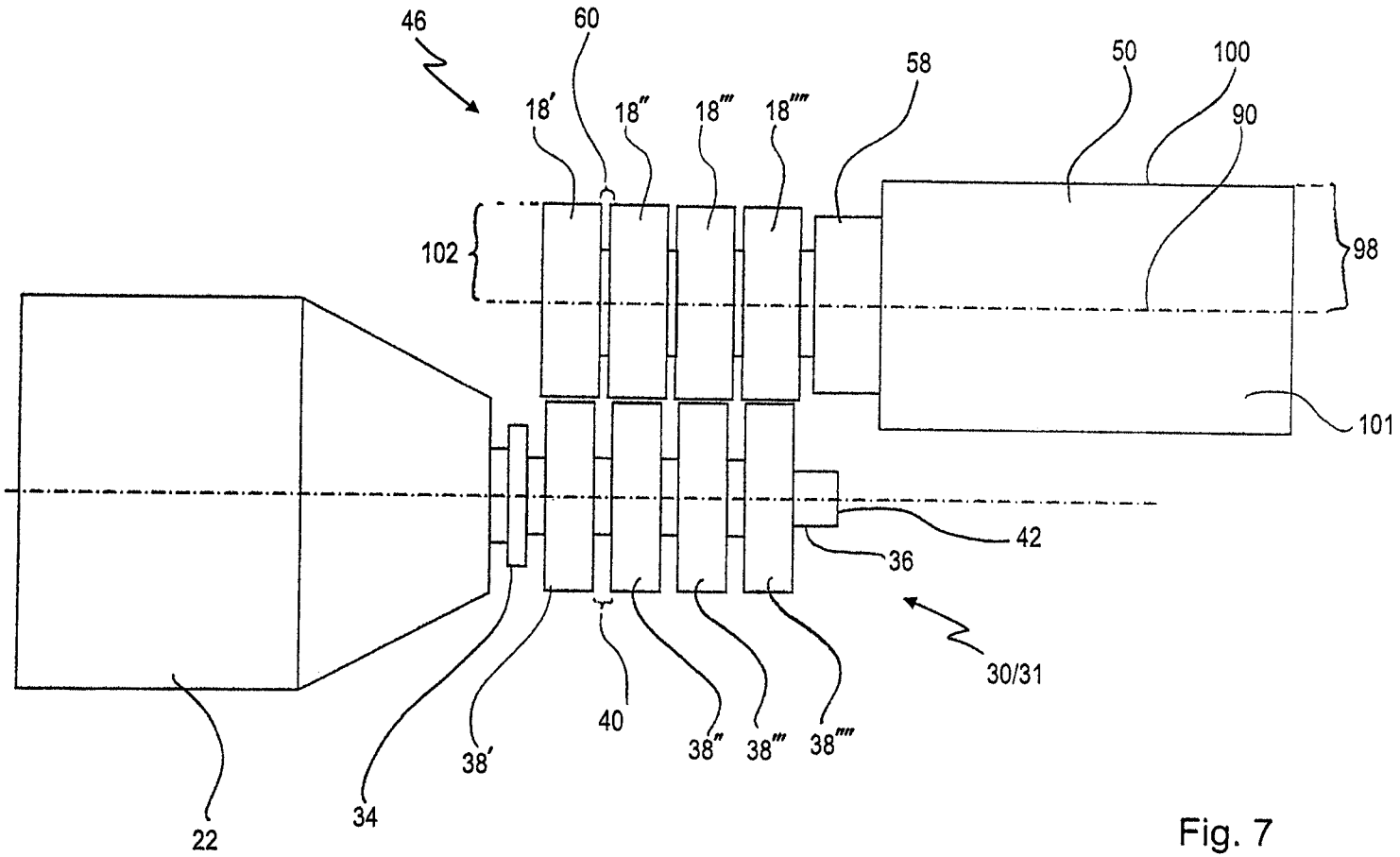
FIG. 7 shows a schematic illustration of clamped workpieces and grinding wheels oriented relative thereto.

The detailed construction of the grinding wheel holders 46, 48 can be seen in particular from FIGS. 6 and 7, in addition to FIGS. 1 to 4. It is to be explained in more detail with reference to the grinding wheel holder 46 having the grinding wheels 18, as shown in FIGS. 6 and 7, but can be applied in the same manner to the corresponding grinding wheel holder 48 having the grinding wheels 20.

It can be seen in FIGS. 6 and 7 that the grinding wheels 18 are arranged on a bar-shaped support element 56. This bar-shaped support element 56 has in turn, at an end 57, a fastening device 58, with which the grinding wheel holder 46 can be arranged on the corresponding grinding wheel 50.

The orientation of the individual grinding wheels 18' to 18"" to one another is such that there is a gap 60 between the adjacent wheels, that is to say between 18' and 18", 18" and 18'", and 18"". In a practical exemplary embodiment, the size of these gaps 60 is around 4 mm.

As can be seen in particular in connection with FIG. 7, the grinding spindle 50 arranged on the slide 54 is oriented in such a way that in each case one of the grinding wheels 18 arranged indirectly on it comes to bear against a cam 38. Ultimately, a grinding wheel 18' to 18"" is therefore assigned to each cam 38' to 38"". There are therefore just as many grinding wheels 18 arranged on the grinding wheel holder 46 as there are cams 38 on the work fixture 30 or the mounting arbor 31. The grinding wheel holder 46 therefore has at least three grinding wheels 18, but preferably four or five grinding wheels 18. In the present example, the first preferred embodiment is shown with four grinding wheels 18 in this respect.

It can also be seen from FIG. 7 that the gaps 40 between the cams 38 are larger than the gaps 60 between the grinding wheels 18. This ensures that, with respect to the view in FIG. 7 and the longitudinal extent of the bar-shaped support 36, a corresponding grinding surface of the grinding wheels 18 faces each cam 38 over its entire width. Furthermore, due to the larger gap 40 between the cams 38, it is possible to provide the grinding wheels 18 with a "roof profile" 61. This roof profile 61 is shown in detail in particular in FIG. 8.

Figure 8:
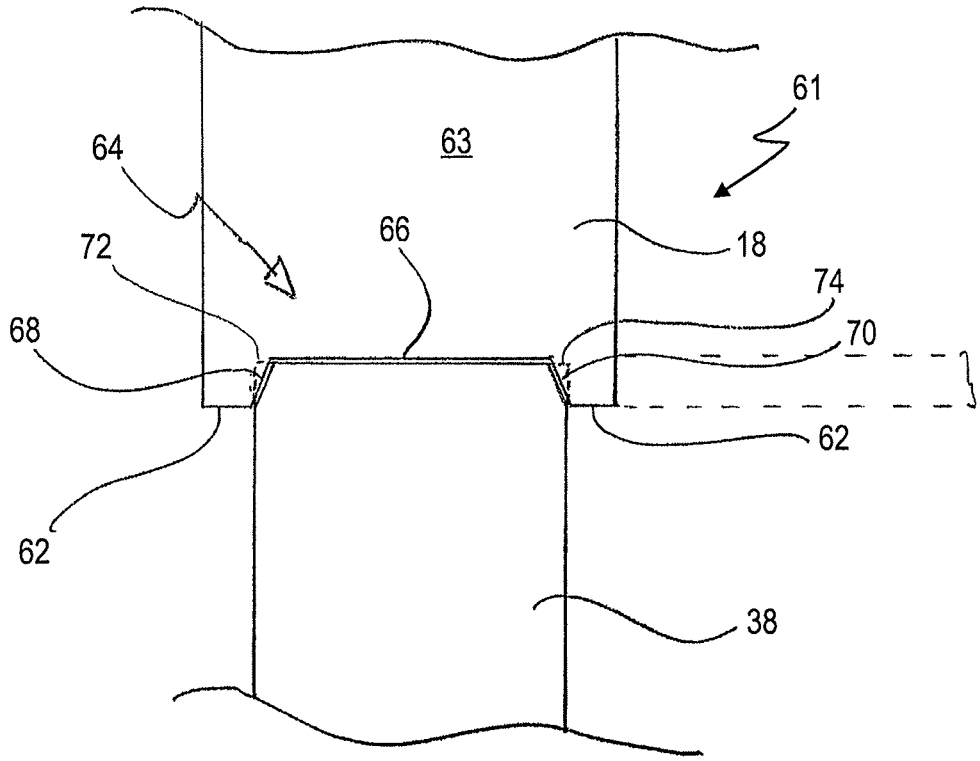
FIG. 8 shows a schematic, greatly enlarged cutaway illustration of a contact region between a workpiece to be machined and a grinding wheel bearing against said workpiece.

An end 62 of the grinding wheel 18 that faces the cam 38 can be seen in the sectional view in FIG. 8, said end 62 having a roof-shaped recess 64 in the grinding material 63. This roof-shaped recess 64 is characterized by an offset in the side facing the cam 38, a factor which manifests itself in the end 62 lying further on the outside and in the end 66 lying further on the inside. These ends 62 and 66 are connected to one another by sloping flanks 68 and 70 as a transition. The result of this offset between ends 62 and 66 and of the sloping flanks 68 and 70 is the profile of the roof-shaped recess 64, which profile can be seen in the sectional view.

The advantage of this configuration of the grinding wheels 18 having the roof-shaped recess 64 is that the formation of burrs on the normally right-angled edges 72, 74 (shown here as broken lines) of the cams 38 to be ground is avoided.

A gap 76 is therefore produced between the ends 62 and 66 of the grinding wheel 18 by the offset. This gap 76 is as a rule arranged within the submillimeter range and is preferably 0.2 mm.

The grinding material 63 of the grinding wheels 18, as have been described above, is a material which accordingly has as long a life as possible and which is suitable for machining cams 38. The grinding material 63 preferably comprises CBN (cubic boron nitride).

Furthermore, in order to remove grinding residues, grinding material residues and inaccuracies from the grinding wheels 18 at regular intervals, the grinding machine 10, in the configuration shown here, has dressers 78 and 80. Said dressers can readily be seen in connection with FIGS. 1 and 3. The dressers 78 and 80 are in each case arranged at the same level of the work headstocks 22 and 24 with respect to the z-axis and are located next to said work headstocks 22 and 24 with respect to the x-axis. Here, they are arranged in such a way that the grinding wheels 18 and 20, respectively, can easily reach them.

The arrangement of the individual elements on the machine bed 12 that have been described above is now to be dealt with in more detail below. In this respect, reference is made in particular to FIGS. 1 to 3.

Figure 2:
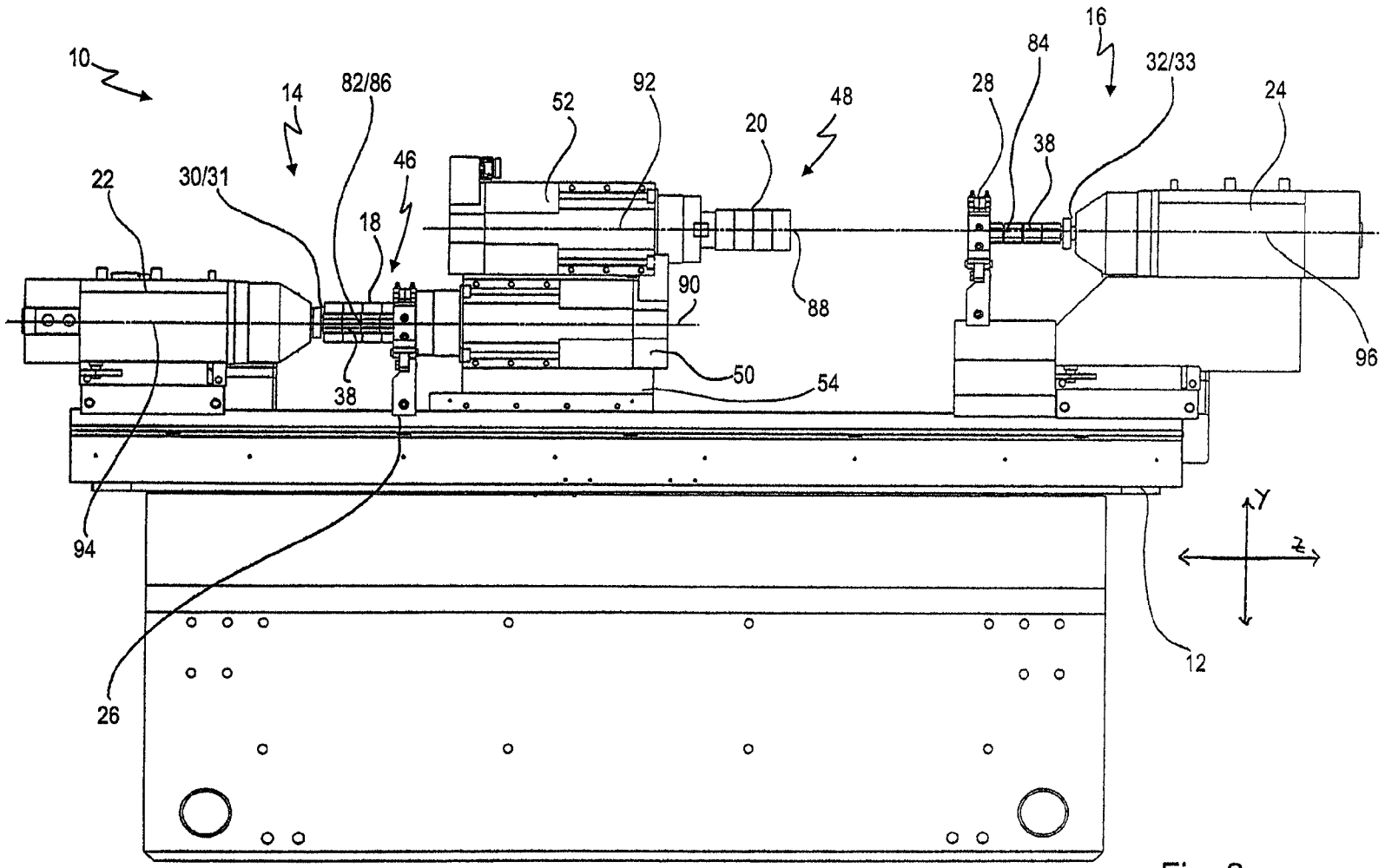
FIG. 2 shows a side view of the machine from FIG. 1 in the direction of view along the x-axis.

As can accordingly be seen in FIGS. 1 and 2, the workholding devices 14 and 16 and the grinding spindles 50 and 52 with the grinding wheel holders 46 and 48 are respectively arranged at different distances above the machine bed 12. In this case, the workholding devices 14 and 16 are oriented relative to one another in such a way that their longitudinal axes 82 and 84 run parallel to the z-axis. The same also applies to the grinding wheel holders 46 and 48 with their longitudinal axes 86 and 88 and to the grinding spindles 50 and 52 with their spindle axes 90 and 92.

Furthermore, the grinding spindles 50 and 52 are arranged relative to one another in such a way that the grinding spindle holders 46 and 48 arranged on them point away from one another in opposite directions along the z-axis.

The workholding devices 14 and 16 are oriented relative to one another in such a way that the steady rests 26 and 28 are arranged between the work headstocks 22 and 24. Overall, with respect to the view in FIGS. 1 to 3, the workholding devices 14 and 16 are arranged at the left-hand margin and right-hand margin, respectively, of the machine bed 12.

Figure 3:
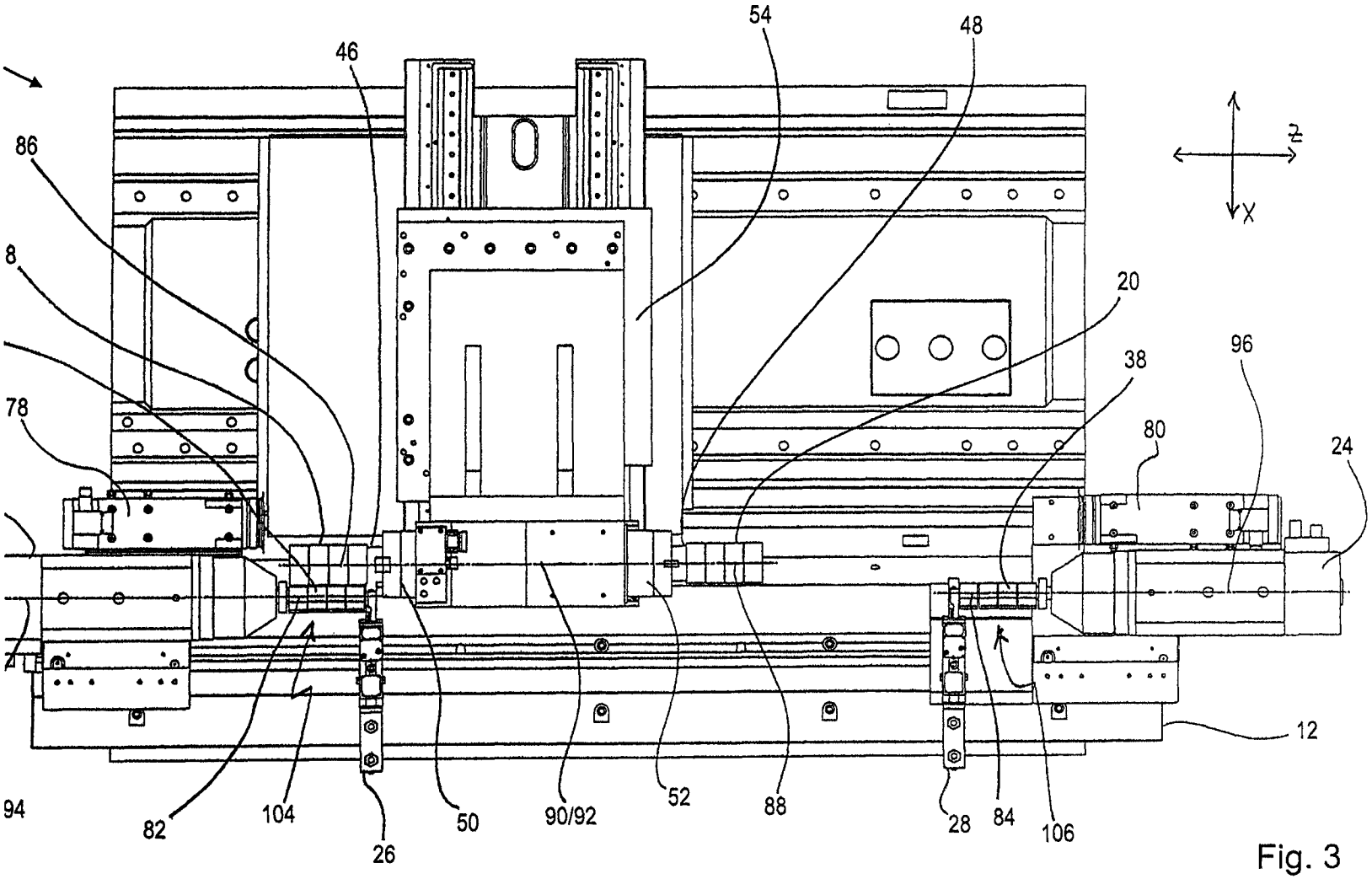
FIG. 3 shows a plan view of the machine in FIGS. 1 and 2, the paper plane being parallel to the x-z plane.

As can be seen in particular from FIG. 3, the workholding devices 14 and 16, in the exemplary embodiment shown here, have in this case a substantially identical arrangement with respect to the x-axis. Accordingly, their longitudinal axes 82 and 84 also have an identical arrangement with respect to the x-axis.

The slide 54 having the grinding spindles 50 and 52 is arranged between the workholding devices 14 and 16 with respect to the z-axis. Furthermore, it is traversable between the workholding devices 14 and 16 along the z-axis. As already explained above, the grinding spindles 50 and 52 with the grinding wheel holders 46, 48 and thus also the grinding wheels 18 and 20 are arranged on the slide 54 at different respective distances from the machine bed. They therefore lie one above the other with respect to the illustration in FIG. 2.

It can additionally be seen in FIG. 3 in this respect that the longitudinal axes 86 and 88 of the grinding wheel holders 46 and 48 and the spindle axes 90 and 92 of the grinding spindles 50 and 52 lie at the same level with respect to the x-axis.

It can be seen in particular from the illustration in FIG. 2 that the longitudinal axis 82 of the workholding device 14 and the longitudinal axis 86 of the grinding wheel holder 46 or the spindle axis 90 of the grinding spindle 50 have the same orientation with respect to the y-axis. The same applies to the orientation with regard to the y-axis for the longitudinal axis 84 of the workholding device 16 and the longitudinal axis 88 of the grinding spindle holder 48 or the spindle axis 92 of the grinding spindle 52.

In other words, the respective longitudinal axes 82 and 86 of the workholding device 14 and grinding wheel holder 46 and the respective longitudinal axes 84 and 88 of the workholding device 16 and grinding wheel holder 48 are at the same common distance above the machine bed 12.

The result of this is that the spindle axis 90 of the grinding spindle 50 is oriented in parallel with the spindle axis 94 of the work headstock 22 and said axes form a plane which is substantially parallel to the x-z plane. Furthermore, the spindle axis 92 of the grinding spindle 52 is oriented in parallel with the spindle axis 96 of the work headstock 24, such that said axes likewise form a plane which is substantially parallel to the x-z plane. In this connection, the expression "substantially parallel" means that the corresponding planes can assume, relative to one another, a small angle differing from 0°, for example within the range of 0 to 10°, but are preferably arranged exactly parallel to one another.

For the grinding spindles 50 and 52 with the grinding wheels 18 and 20, FIG. 7 shows the relative sizes between grinding spindles 50 and 52 and grinding wheels 18 and 20, respectively, taking the grinding spindle 50 and the grinding wheels 18 as an example. It can be seen there that the distance 98 between the spindle axis 90 and an outer edge 100 of the spindle block 101 of the grinding spindle 50, which distance 98 is also designated as spindle block size, is greater than the radius 102 of the grinding wheels 18.

This is possible owing to the fact that the steady rest 26 or the steady rest 28 has a small extent in the direction of the z-axis, as would be the case, for example, with a tailstock (not shown here). It can thus be seen, for example in FIG. 1, that the steady rests 26 and 28 each only have a small width in the direction of the z-axis. This width (not designated in any more detail here) corresponds approximately to the free support end 42 of the bar-shaped support 36. Furthermore, the space in the direction of the z-axis between the steady rests 26 and 28 is otherwise completely free. Accordingly, the space required by the grinding spindles 50 and 52 in the direction of the x-axis, in other words the distance 98 or the spindle block size, can be virtually any desired size. This permits the use of high-performance grinding spindles 50 and 52.

The method, which is likewise the subject matter of the present invention, is to be briefly described below. In this respect, reference may be made in particular to FIGS. 1 to 3.

In a first step of the method for grinding cam sets using a grinding machine 10, as is an essential part of the invention, a first cam set 104 is clamped automatically in the workholding device 14. The clamping operation is not shown in any more detail in the figures. This cam set 104 is then clamped in place between work headstock 22 and steady rest 26 and is then set in rotation about the spindle axis 94 of the work headstock 22.

After that, the grinding spindle 50 is oriented along the z- and x-axes. This is done in such a way that a respective cam 38 of the cam set 104 and a respective grinding wheel 18 of the grinding wheel holder 46 on the grinding spindle 50 are at one level with respect to the z-axis. Furthermore, the corresponding grinding wheels 18 and cams 38 are then brought into contact by traverse of the grinding spindle 50 in the direction of the x-axis in such a way that grinding is possible. This state can be seen, for example, in FIGS. 1 to 3 and in a simplified manner in detail in FIG. 7. After that, the cams are ground.

As the next step, but preferably at the same time as the orientation and grinding operation described above, a cam set 106 possibly clamped in the workholding device 16 is deposited automatically. This cam set 106 as a rule originates from a previous grinding operation and therefore contains ground cams 38.

Then, in the same step, another cam set 106' (not shown in any more detail here) having unground cams 38 is automatically clamped in place in the workholding device 16. In accordance with the method steps described above, this cam set 106' is then located in a clamped manner between work headstock 24 and steady rest 28 and is henceforth set in rotation by the work headstock 24 about the spindle axis 96 of the latter.

As soon as the grinding operation taking place in the meantime on the cam set 104 is complete, the grinding spindle 52 with the grinding wheel holder 48 and the grinding wheels 20 is oriented relative to the cam set 106'. To this end, the grinding spindle 50 is first of all moved in the direction of the x-axis in such a way that the grinding wheels 18 are spaced-apart from the cams 38 of the cam set 104. The grinding wheels 20 are then oriented relative to the cams 38 of the cam set 106', such that said grinding wheels and said cams come to lie at one level with respect to the z-axis, as has already been described above for the method step with the cam set 104. After the grinding spindle 52 together with the grinding wheels 20 is moved in the direction of the x-axis into a position corresponding to FIG. 7, the cams 38 of the cam set 106' are ground by the grinding wheels 20.

The next method step, which preferably takes place at the same time as the orienting and grinding step described above, comprises the automatic depositing of the cam set 104, which has just been ground, from the workholding device 14.

After that, an unground cam set 104' (not shown in any more detail) is then automatically clamped in place in the workholding device 14, as has already been described at the start of this method. The following steps are repeated in an identical manner in accordance with the previous description of the method.

The steps of the automatic depositing and clamping that are mentioned here are preferably carried out with automatic devices (not explained or shown in any more detail in this connection), as known from the prior art for this purpose.

As can be seen in this method, the times during which the grinding wheels 18 and 20 are not active, the "non-productive times", merely comprise the orientation step of the grinding spindle 50 or 52.

This, together with the possibility of being able to use grinding spindles having larger spindle block sizes, that is to say grinding spindles having a higher performance, increases the productivity of the grinding machine 10 according to the invention with regard to the ground cams by a factor of up to 8 per unit of time compared with the hitherto known grinding machines for cams.

It should be noted that the orientation of the complete grinding machine or of parts thereof can not only be selected as shown in the figures, but can also be selected differently. In particular, in an embodiment, the complete grinding machine can be arranged in an orientation that is at 90° tilted with respect to the orientation shown in the figures so that the rotation axes and the longitudinal axes, respectively, of the grinding wheels and the workpieces are oriented in vertical direction and not, as shown in the figures, in horizontal direction.

What is claimed:

1. Grinding machine for grinding workpieces, in particular cams, comprising a machine bed, at least one grinding spindle, two grinding wheel holders, on each of which at least one grinding wheel is arranged, which are arranged in opposite directions to one another in their orientation and whose longitudinal axes are oriented parallel to one another, and two workholding devices, each having a work headstock and a steady rest, which are arranged in opposite directions to one another in their orientation and whose longitudinal axes are oriented parallel to one another, wherein each work headstock and the associated steady rest are designed for the arrangement therebetween of a separate work fixture having workpieces to be ground.

2. Grinding machine according to claim 1, wherein the steady rests are arranged along a z-axis between the work headstocks.

3. Grinding machine according to claim 1, wherein the at least one grinding spindle is a single grinding spindle, wherein one of each of the two grinding wheel holders is arranged on a respective side of two oppositely arranged sides of the single grinding spindle.

4. Grinding machine according to claim 1, wherein the at least one grinding spindle comprises two separate grinding spindles, wherein one of each of the two grinding wheel holders is arranged on a respective one of the two separate grinding spindles.

5. Grinding machine according to claim 4, wherein the two separate grinding spindles are jointly arranged on a slide which is arranged on the machine bed in a traversable manner.

6. Grinding machine according to claim 4, wherein the two workholding devices are each arranged at different distances above the machine bed and the two grinding wheel holders are each arranged at different distances above the machine bed.

7. Grinding machine according to claim 4, wherein the two workholding devices are each arranged at the same distance above the machine bed and the two grinding wheel holders are each arranged at the same distance above the machine bed.

8. Grinding machine according to claim 4, wherein the spindle axis of a respective work headstock is arranged in a plane with the spindle axis of a respective grinding spindle, said plane being substantially parallel to a plane defined by x- and z-axes.

9. Grinding machine according to claim 1, wherein at least three grinding wheels are arranged on at least one of the two grinding wheel holders.

10. Grinding machine according to claim 1, wherein the radial distance from the spindle axis of the at least one grinding spindle up to an outer edge of a spindle block of the grinding spindle is greater than or equal to the radius of the grinding wheels.

11. Grinding machine according to claim 1, wherein the grinding wheels each have a roof profile.

* * * * *